US006123782A

United States Patent [19]

Rosengard

[11] Patent Number: 6,123,782

[45] Date of Patent: Sep. 26, 2000

[54] NONCHROMATED, PRIMER-FREE, SURFACE PREPARATION FOR PAINTING, POWDER COATING AND ADHESIVE BONDING

[75] Inventor: Jordan L. Rosengard, Woodland Hills, Calif.

[73] Assignee: Raytheon Company, Lexington, Mass.

[21] Appl. No.: 08/447,465

[22] Filed: May 23, 1995

Related U.S. Application Data

[63] Continuation of application No. 08/250,260, May 27, 1994, abandoned.

[51] Int. Cl.[7] ..... C23C 22/56

[52] U.S. Cl. ..... 148/275

[58] Field of Search ..... 148/275

[56] References Cited

U.S. PATENT DOCUMENTS

| | | | |
|---|---|---|---|
| 3,380,860 | 4/1968 | Lipinsk | 148/275 |
| 3,544,391 | 12/1970 | Scott | 148/275 |
| 4,451,304 | 5/1984 | Batick | 148/275 |
| 4,711,667 | 12/1987 | Bibber | 106/14.21 |
| 4,759,805 | 7/1988 | Saruwatari | 148/275 |
| 5,052,421 | 10/1991 | McMiller | 148/275 |
| 5,192,374 | 3/1993 | Kindler | 148/275 |

OTHER PUBLICATIONS

"Cerium Conversion Coatings for the Corrosion Protection of Aluminum", *Materials Forum*, vol. 9, No. 3, pp. 162–173 (1986).

*Primary Examiner*—John Sheehan
*Assistant Examiner*—Andrew L. Oltmans
*Attorney, Agent, or Firm*—Colin M. Raufer; Leonard A. Alkov; Glenn H. Lenzen, Jr.

[57] ABSTRACT

An improved method of providing a protective coating on the surface of aluminum or aluminum alloys comprising: alkaline-cleaning the surface using a nonchromated and nonsilicated alkaline cleaner, following by a rinse in hot water; (b) deoxidizing the surface by immersion thereof in a nonchromated deoxidizer at room temperature, followed by a rinse in hot water; and (c) immersing the surface in boiling water for a period of time. Following the immersion step, the aluminum-containing part may be painted, powder-coated, or adhesive-bonded without requiring any wash primers to activate the substrate. Further, the part may be stored indefinitely in an acid-free paper that does not leave any residues. The only treatment required before painting, powder-coating, or adhesive bonding is a removal of any fingerprints in a suitable solvent such as acetone or iso-propyl alcohol.

4 Claims, No Drawings

NONCHROMATED, PRIMER-FREE, SURFACE PREPARATION FOR PAINTING, POWDER COATING AND ADHESIVE BONDING

This is a continuation application Ser. No. 08/250,260 filed May 27, 1994 now abandoned.

BACKGROUND OF THE INVENTION

1. Field of the Invention

The present invention relates to a method for pretreating the surface of aluminum and its alloys to prepare it to receive a coating to protect against corrosion or to improve adhesion of paint. In particular, the present invention relates to a surface preparation method that prepares the surface to provide an improved coating on aluminum and its alloys.

2. Description of Related Art

Aluminum and aluminum alloys are frequently used to form structures, such as for use in manufacturing aircraft, in which corrosion resistance is required or in which good paint adhesion is required. Aluminum has a natural oxide film which protects it from many corrosive influences. This natural oxide is, however, not sufficiently resistant to such highly corrosive environments as saltwater, nor is it a good base for paints. Improved films, which are both more corrosion resistant and suitable as a base for paints can generally be formed on the surface of aluminum either by anodizing or by chromate conversion. During the anodizing process, aluminum oxide is formed on the aluminum surface, and provides a very corrosion resistant surface which can be dyed or painted. However, anodizing has the disadvantage of high electrical resistance, higher cost, longer processing time, and the need to make direct electrical contact with the part. This latter requirement complicates processing considerably.

Chromate conversion coatings are formed by dipping the aluminum part in chromic acid, to provide a coating comprising chromium oxide(s) mixed with aluminum oxide. Chromate conversion coatings are corrosion resistant, provide a suitable base for paint, can be rapidly applied, self-heal when scratched, and are very cheap. Furthermore, chromate coatings are reasonably conductive and can be used in sealing surfaces for electromagnetic interference gaskets. The conductive characteristics provided by chromate conversion coating are not characteristic of anodized coatings nor of most protective coatings. Unfortunately, the hexavalent chrome used in producing these cheap, reliable, and useful coatings poses serious health hazards as well as significant disposal problems. Dermatitis and skin cancer have been associated with the mere handling of chromated aluminum parts. Severe damage to mucous membranes and skin lesions called "chrome sores" occur from exposure to the ever-present chrome mist in plating shops. Such health hazards to humans represent a major problem in the use of chrome for protecting aluminum. Thus, it would be desirable to replace the chromating process entirely.

Wash primers have been used in place of chromated conversion coatings. However, these usually contain phosphoric acid and chromates in order to promote adhesion of paint, powder coatings, and adhesive bonded joints.

A recently developed process which eliminates the use of chromium involves coating aluminum surfaces with a film of aluminum oxyhydroxide (pseudo-boehmite), as disclosed in U.S. Pat. No. 4,711,667, entitled "Corrosion Resistant Aluminum Coating". The process comprises, following degreasing, cleaning the aluminum-containing part in a cleaning solution which does not interfere with the bonding of the corrosion-resistant coating onto the surface of the part. Then, an aqueous solution comprising an alkali metal permanganate and a buffer compound is applied to the surface of the aluminum-containing part. This process yields a coating which is not as conductive as a chromate conversion coating, but is not, however, an insulator. In addition, its corrosion resistance is not as good as that produced by chromate conversion. This process is referred to herein as the "Sanchem process".

In another known method, aluminum has been treated with cerium chloride, $CeCl_3$, to form a mixed cerium oxide/cermium hydroxide film on the surface, as described, for example, by B. R. W. Hinton et al, "Cerium Conversion Coatings for the Corrosion Protection of Aluminum", *Materials Forum*, Vol. 9, No. 3, pp. 162–173 (1986). In this process, a coating of cerium oxide/hydroxide is precipitated on the aluminum surface and provides a relatively high degree of corrosion resistance. Unfortunately, this process is slow, taking almost 200 hours. The speed of the process can be improved so that the coverage can occur in 2 to 3 minutes by cathodically polarizing the coupon. However, this leads to a less durable coating, and the process is inconvenient because it requires the use of electrodes.

Application U.S. Pat. No. 5,192,374, filed Sep. 27, 1991, and assigned to the same assignee as the present application, discloses an improved method of providing a protective coating on the surface of aluminum or aluminum alloys, comprising: removing contaminants from the surface; exposing the surface to water at 50° to 100° C. to form a porous boehmite coating on the surface; and exposing the boehmite-coated surface to an aqueous solution comprising a cerium salt and a metal nitrate at a temperature of 70° to 100° C. Oxides and nitrides of cerium are formed within the pores of the boehmite to provide the protective coating, which provides corrosion resistance and improved paint adhesion. This process is referred to herein as the "Hughes long form process".

Work continues to develop processes that reduce the number of steps or otherwise provide improved adhesion of paints and improved corrosion resistance of aluminum and its alloys for painting, powder coating, and adhesive bonding without the use of chromated conversion coatings or wash primers. For example, the prior art of using a chemical film for a paint base requires painting within an 8 hour period, otherwise, adhesion to base materials (aluminum alloys) is not reliable. In the event that the 8 hour period is exceeded, the chemical film must be removed and a primer used prior to painting with the standard painting process. For example, a wash primer per MIL-P-8514, "Coating Compound, Metal. Pretreatment; Resin Acid" is employed, followed by an epoxy primer and a polyurethane top coat.

However, there remains a need for a process that is not subject to any time constraints and does not require the use of a wash primer to activate the aluminum substrate. Such a process should be relatively short in duration and avoid the use of expensive chemicals, while providing substantially the same results as more expensive, longer processes.

SUMMARY OF THE INVENTION

In accordance with the invention, a nonchromated, primer-free process is provided for preparing the surface of aluminum and aluminum alloy parts for receiving paints, powders, and adhesives. The process comprises:

(a) alkaline-cleaning the part using a nonchromated and nonsilicated alkaline cleaner, following by a rinse in hot water;

(b) deoxidizing the surface of the part by immersing the part in a nonchromated deoxidizer at room temperature, followed by a rinse in hot water; and (c) immersing the part in boiling deionized or distilled water for a period of time.

Following the immersion step, the aluminum-containing part may be painted, powder-coated, or adhesive-bonded without requiring any wash primers to activate the substrate. Further, the part may be stored indefinitely in an acid-free paper that does not leave any residues indefinitely. The only treatment required before painting, powder-coating, or adhesive bonding is a removal of any fingerprints in a suitable solvent such as acetone or isopropyl alcohol. The process of the invention is simpler than the prior art processes and avoids the use of expensive chemicals, such as metal alkali permanganates and cerium salts, while providing a surface coating that is essentially of the same quality as that provided by the prior art processes.

DESCRIPTION OF THE PREFERRED EMBODIMENTS

The present invention comprises three basic steps to produce a paintable or bondable surface on aluminum alloys such as 2024, etc. The basic process steps for cleaning the surfaces of aluminum alloy parts are as follows:

First, the aluminum alloy part is alkaline-cleaned using a nonchromated and nonsilicated alkaline cleaner. The aluminum alloy part is then rinsed in hot water. The use of a nonsilicated alkaline cleaner avoids silicate deposits, to which coatings do not stick. Examples of suitable alkaline cleaners include CHEMIDIZE 740, available from Allied Kellite, and TURCO 4215 NCLT, available from Turco Products.

Next, the surface is deoxidized by using a nonchromated deoxidizer. The nonchromated deoxidizer may be any of the commercially-available deoxidizers, such as SANCHEM 1000, which contains 10% nitric acid and 3% sodium bromate, SMUT-GO NC, which contains 10% nitric acid, 30% ferric sulfate, and less than 5% ammonium bifluoride, and SANCHEM 2000, which contains lithium nitrate and aluminum nitrate, to which cerium chloride may be added. However, since SANCHEM 1000 has been found to provide the smoothest surface, that deoxidizer is preferred.

The deoxidation may be performed at room temperature or at an elevated temperature up to about 120° F. (48.9° C.). The aluminum alloy part is then rinsed in hot water.

The part is next immersed in boiling deionized or distilled water for a period of time sufficient to form a surface film of aluminum oxyhydroxide, also known as "pseudo-bohemite". Typically, immersion in boiling water for about 5 to 10 minutes is sufficient to form the surface film.

Following the immersion step, the aluminum-containing part may be painted, powder-coated, or adhesive-bonded without requiring any wash primers. Further, the part may be stored indefinitely in an acid-free paper, such as kraft paper, that does not leave any residues. The only treatment required before painting, powder-coating, or adhesive bonding is a removal of any fingerprints in a suitable solvent such as acetone or iso-propyl alcohol.

Although the three steps have been employed in an earlier process, such as the above-referenced U.S. Pat. No. 4,711,667 (the "Sanchem process") and U.S. Pat. No. 5,192,374 (the "Hughes long form process"), additional steps have been employed in these references to provide corrosion resistance to the aluminum-containing part. For example, following the immersion in hot water, the Sanchem process adds the following steps:

(1) immerse the part in an aqueous solution of 1% lithium nitrate and 1% aluminum nitrate at 97° to 100° C. for 5 minutes, followed by a rinse in deionized (D.I.) water;

(2) immerse the part in an aqueous solution of 0.25% $KMnO_4$ for 5 minutes at 57° to 60° C., followed by a rinse in D.I. water; and (3) immerse the part in an aqueous solution of 10% potassium silicate at 90° to 95° C. for 1½ minutes, followed by a rinse in D.I. water and blow dry.

The foregoing Sanchem process provides the surface of aluminum and aluminum alloys with a corrosion-resistant coating.

The Hughes long form process replaces the added steps of the Sanchem process with exposure of the parts to an aqueous solution comprising a cerium salt and a metal nitrate at a temperature of 70° to 100° C. for a time sufficient to form oxides and hydroxides of cerium within the pores of a porous bohemite coating formed during the immersion in hot water. The resulting process provides the surface of aluminum or aluminum alloys with a protective, that is, corrosion-resistant, coating.

Neither reference, however, discloses a simple, effective process for rendering the surface suitable for painting, powder-coating, or adhesion bonding. Applicant's process, which incorporates the first three steps that are common to both processes, surprisingly and unexpectedly provides the surface of aluminum-containing parts with a corrosion-resistant coating that is essentially of the same quality as that produced by both the Sanchem and Hughes long form processes.

Following the immersion in boiling water, the aluminum-containing parts are dried by a process that includes removal of excess water by blowing with gaseous $N_2$, followed by drying at 160° F. (72.1° C.) for at least ½ hour.

Next, the part is packaged in clean kraft paper prior to painting or adhesive bonding. Kraft paper is acid-free and does not leave any residues on the part. The part may be stored in the kraft paper indefinitely.

EXAMPLES

Example 1

A series of lap shear specimens were prepared using Epiphen 825A as the adhesive. EPIPHEN 825A is a four-component epoxy, available from MTM Research Chemicals (Huntindon, Pa.). In all cases, four test coupons were prepared for each set of process conditions. Table I below lists the sample number, the specific conditions of deoxidizer, the stress, the mean, and the standard deviation. The stress values are given in terms of pounds per square inch, with the corresponding values in kg/cm$^2$ given in parentheses.

A modified Sanchem process was used for comparison, employing two different process conditions, hot deoxidizer and cold deoxidizer. In both processes, aluminum alloy 2024-T3 parts were cleaned in CHEMIDIZE 740 alkaline cleaner, deoxidized in SANCHEM 1000 deoxidizer, soaked in hot D.I. water, immersed in SANCHEM 2000 with 0.1% $CeCl_3$, and dried. The specific deoxidizer and deoxidation conditions are listed in Table I, below, for Samples 1–4.

For the process of the invention, aluminum alloy 2024-T3 parts were cleaned in CHEMIDIZE 740 alkaline cleaner, deoxidized in a deoxidizer, soaked in hot D.I. water, and dried. Two different deoxidizers were employed, SANCHEM 1000 and SMUT-GO NC, both under hot and cold deoxidizer conditions. The specific deoxidizer and deoxidation conditions are listed in Table I, below, for Samples 5–9 (SANCHEM 1000) and Samples 10–12 (SMUT-GO NC).

TABLE I

Chromate Conversion Coating Replacement Lap Shear Data.

| Sample | Deoxidizer | Stress | Mean | Std. Dev. |
|---|---|---|---|---|
| Sanchem Process: | | | | |
| 1 | SANCHEM 1000 at 34° C. for 20 min. (Hot deoxidizer) | 1771 (124.5)<br>1947 (136.9)<br>1453 (102.1)<br>1568 (110.2) | 1685 (118.4) | 219 (15.4) |
| 2 | SANCHEM 1000 at 32° C. for 20 min. (Hot deoxidizer) | 2494 (175.3)<br>2127 (149.5)<br>780 (54.8)<br>2080 (146.2) | 2233 (157.0) | 226 (15.9) |
| 3 | SANCHEM 1000 at 22° C. for 40 min. (Cold deoxidizer) | 1908 (134.1)<br>2275 (159.9)<br>2076 (145.9)<br>1937 (136.2) | 2049 (144.0) | 167 (11.7) |
| 4 | SANCHEM 1000 at 23° C. for 20 min. (Cold deoxidizer) | 2107 (148.1)<br>1496 (105.2)<br>1806 (127.0)<br>2055 (144.5) | 1866 (131.2) | 280 (19.7) |
| This Invention: | | | | |
| 5 | SANCHEM 1000 at 34° C. for 20 min. (Hot deoxidizer) | 1636 (115.0)<br>1834 (178.9)<br>1474 (103.6)<br>1780 (125.1) | 1681 (118.2) | 162 (11.4) |
| 6 | SANCHEM 1000 at 32° C. for 20 min. (Hot deoxidizer) | 2164 (152.1)<br>1424 (100.1)<br>2500 (175.8)<br>2262 (159.0) | 2087 (146.7) | 465 (32.7) |
| 7 | SANCHEM 1000 at 22° C. for 40 min. (Cold deoxidizer) | 2591 (182.1)<br>2007 (141.1)<br>1918 (134.8)<br>2794 (196.4) | 2327 (163.6) | 431 (30.3) |
| 8 | SANCHEM 1000 at 60° C. for 60 min. (Hot deoxidizer) | 2368 (166.5)<br>1110 (78.0)<br>2403 (168.9)<br>1937 (136.2) | 1954 (137.4) | 601 (42.2) |
| 9 | SANCHEM 1000 at 23° C. for 20 min. (Cold deoxidizer) | 1731 (121.7)<br>1584 (111.4)<br>2261 (158.9)<br>2045 (143.8) | 1905 (133.9) | 305 (21.4) |
| 10 | SMUT-GO at 60° C. for 8 min. (Hot deoxidizer) | 1766 (124.1)<br>1272 (89.4)<br>1466 (103.1)<br>1375 (96.7) | 1470 (103.3) | 213 (15.0) |
| 11 | SMUT-GO at 23° C. for 6 min. (Cold deoxidizer) | 1612 (113.3)<br>1951 (137.2)<br>2265 (159.2)<br>2316 (162.8) | 2036 (143.1) | 326 (22.9) |
| 12 | SMUT-GO at 27° C. for 6 min. (Cold deoxidizer) | 2804 (197.1)<br>2120 (149.0)<br>2185 (153.6)<br>2451 (172.3) | 2390 (168.0) | 311 (21.9) |

As can be seen in Table I, the strength developed using the process of the invention approaches the structural requirements of at least 3,000 pounds per square inch (210.9 kg/m$^2$). Additional work is planned to refine this procedure so that adhesive bonding can be performed without primers and to achieve the minimum structural requirements. In any event, it is clear that the process of the invention, which requires fewer steps than the Sanchem process, provides lap shear values that are as good as the prior art process.

Example 2

Test panels were prepared and painted with CHEMGLAZE Z-306 (black) and CHEMGLAZE A-276 (white). CHEMGLAZE paints are available from Lord (Erie, Pa.). Comparison was made between the Sanchem process, the Hughes long form process ("HAC, lf"), and the Hughes short form process ("HAC, sf") of the present invention.

All samples passed the tape test, adhesion cross hatch test and a screening test of 168 hours in salt fog 5±1% at 95° F. (35° C.), 95% relative humidity, per ASTM Standard B117, "Standard Method of Salt Spray (Fog) Testing". All the panels survived and were then subjected to a 180° bend test. The paint did not peel off. The paint was applied without wash primers and the panels were painted at least 18 days (d) after preparation. This was done to establish a baseline that the coating has a long life prior to painting. Additional paint samples are in test 2 to 3 months after preparation and thus far and unaffected. The results are summarized in Table II, below.

TABLE II

Corrosion Test Results of Paint Samples.

| Process | Alloy | Paint | Results[a] | Bend[a] | Remarks[b] |
|---|---|---|---|---|---|
| Sanchem | 2024-T3 | Bl Z306 | All pass | 180° | 18 d |
| Sanchem | 2024-T3 | Wh A276 | All pass | 180° | 18 d |
| Sanchem | 6061-T4 | Bl Z306 | All pass | 180° | 18 d |
| Sanchem | 6061-T4 | Wh A276 | All pass | 180° | 18 d |
| Sanchem | 2024-T3 | Bl Z306 | All pass | 180° | 67 d |
| HAC, lf | 2024-T3 | Bl Z306 | All pass | 180° | 18 d |
| HAC, lf | 2024-T3 | Wh A276 | All pass | 180° | 18 d |
| HAC, lf | 6061-T4 | Bl Z306 | All pass | 180° | 18 d |
| HAC, lf | 2024-T3 | Bl Z306 | All pass | 180° | 90 d |
| HAC, sf | 2024-T3 | Bl Z306 | All pass | 180° | 18 d |
| HAC, sf | 2024-T3 | Wh A276 | All pass | 180° | 18 d |
| HAC, sf | 2024-T3 | Bl Z306 | All pass | 180° | 82 d |
| HAC, sf | 2024-T3 | Bl Z306 | All pass | 180° | 36 d |
| HAC, sf | 2024-T3 | Bl Z306 | All pass | 180° | 42 d |
| HAC, sf | 2024-T3 | Bl Z306 | All pass | 180° | 42 d |

Notes:
[a]Panels passed adhesion test, in addition to a 180° bend test at the conclusion of the test.
[b]Days painted after processing.

Again, it is clear that the shorter process of the invention is at least as good as the longer prior art processes.

Example 3

A set of aluminum alloy 2024-T3 panels were prepared for powder coating and subsequent corrosion testing. Prior to powder coating the panels were subjected to the HAC nonchromated long form (lf) and short form (sf; the present invention) processes as well as the standard Sanchem nonchromated process. The panels were coated with epoxy type materials consisting of two gloss white powder coatings, two gloss black powder coating and one clear powder coating as described below:

Gloss White SPRAYLAT PEL 9258
TIGER DRYLAT 269/10130

Gloss Black FERRO VE 357
PRATT & LAMBERT 88-1046

Clear FULLER-O'BRIEN EFC 500-59.

All the coatings were cured at 250° F. (121.1° C.) for one hour and subsequently were scribed with an "X" to bare metal and exposed to a salt fog test per ASTM B117 for 1,000 hours. A set of control panels of chromated conversion coated panels per MIL-C-5541, "Chemical Conversion Coating on Aluminum and Aluminum Alloys", was prepared and coated using the above epoxy materials. The corrosion resistance of all the nonchromated panels, HAC and Sanchem, was equal to or better than the chromated chemical film control panels. The results are tabulated in Table III, below.

TABLE III

Powder Coating Corrosion Tests.

| Powder Coating Designation | Observations |
|---|---|
| Gloss White SPRAYLAT PEL 9258 | Nonchromated panels had little or no corrosion, while chem film, chromated conversion coating had blistering. |
| Gloss White TIGER DRYLAT 269/10130 | Nonchromated panels exhibited little or no corrosion. Looked just as good if not better than chromated coating. |
| Gloss Black FERRO VE 357 | Nonchromated HAC panels performed better than Sanchem with little or no corrosion. |
| Gloss Black PRATT & LAMBERT 88-1046 | All nonchromated panels performed equally with little or no corrosion. |
| Clear FULLER-O'BRIEN EFC 500-69 | Nonchromated panels had little or no corrosion and performed better than the standard chromated coating. |

Again, as in the previous Examples, Table III indicates that the shorter process of the invention provides at least as good results as the longer processes of the prior art.

Thus, there has been disclosed a process for preparing the surface of aluminum and aluminum alloys which avoids the use of chromates and primers for the application of paint, powder coating, and adhesives thereto. It will be appreciated by those skilled in the art that various modifications and changes of an obvious nature may be made without departing from the scope of the invention, and all such modifications and changes are intended to fall within the scope of the invention, as defined by the appended claims.

What is claimed is:

1. A method for providing the surface of aluminum-containing materials with a chromate-free protective coating consisting of:

(a) alkaline-cleaning said surface using a non-chromated and nonsilicated alkaline cleaner, following by a rinse in hot water;

(b) deoxidizing said surface by immersing thereof in a nonchromated deoxidizer at room temperature, followed by a rinse in hot water; and (c) immersing said surface in boiling water for a period of time ranging from about 5 to 10 minutes to thereby form a film of aluminum oxyhydroxide on said surface wherein said film provides said protective coating.

2. The method of claim 1 wherein said protective coating provides resistance to corrosion.

3. The method of claim 1 wherein said protective coating provides a surface for adhesion of paint.

4. The method of claim 1 wherein said nonchromated deoxidizer contains 10% nitric acid and 3% sodium bromate.

* * * * *